United States Patent [19]

Legge

[11] 4,383,426

[45] May 17, 1983

[54] DIE CONSTRUCTION FOR FAN BLADES

[75] Inventor: John R. Legge, Durham, Conn.

[73] Assignee: United Technologies Corporation, Hartford, Conn.

[21] Appl. No.: 243,688

[22] Filed: Mar. 16, 1981

[51] Int. Cl.[3] ..... B21D 22/10

[52] U.S. Cl. ..... 72/63; 29/156.8 B; 29/421 R

[58] Field of Search ..... 72/60, 63, 61; 29/421 R, 156.8 B, 156.8 P

[56] References Cited

U.S. PATENT DOCUMENTS 3,701,190 10/1972 Stone, Jr. ..... 29/156.8

4,087,037 5/1978 Schier et al. ..... 228/106

4,188,811 2/1980 Brimm ..... 72/63

4,301,584 11/1981 Dillner et al. ..... 72/63

*Primary Examiner*—Leon Gilden

*Attorney, Agent, or Firm*—Charles A. Warren

[57] ABSTRACT

A die construction for forming or reforming a fan blade to press dies in which opposed dies have cooperating cavities to form a recess to receive the blade, at least a part of one of the cavities having a diaphragm welded thereto to form a chamber beneath the diaphragm so that by pressing the chamber the adjacent part of the blade will be shaped against the surface of the opposing recess.

10 Claims, 2 Drawing Figures

DIE CONSTRUCTION FOR FAN BLADES

DESCRIPTION

1. Technical Field

This invention relates to a die construction by which to bend a fan blade to meet the required inspection dimensions to restore a fan blade to the original configuration, and is particularly useful in reshaping a used fan blade of a gas turbine engine to meet the original dimensions.

2. Background Art

Dies have been used for shaping composite articles such as fan blades and a flexible membrane is used in order to give a uniform pressure over the entire article. An example is shown in Stone U.S. Pat. No. 3,701,190. The purpose of this device is to provide a uniform compaction over the entire blade surface. On the contrary in bending a vane or blade to establish the desired dimensions at leading and/or trailing edges it is more essential to have localized pressures to bend the blade in selected areas. Further this patented structure is concerned with a composite blade and it is shaped against a blade forming surface in one of the dies. The other blade surface, not in contact with the die but contacted by the flexible membrane is not necessarily shaped to the desired contour.

DISCLOSURE OF THE INVENTION

Where a new fan blade or vane is not within the required tolerances it is frequently possible to bend the vane in selected areas against a die in order to establish the desired angles and dimensions to meet the established dimensional requirements. This is also true of used fan blades where they may have been somewhat bent in use. A feature of the invention is an arrangement for heating the blade in a pair of dies and, when hot pressing the blade against one of these dies to shape the blade to conform to the die by utilizing inert gas pressing against a diaphragm engaging at least a part of the blade. To prevent gas leakage at the necessary high temperatures the diaphragm must be metallic and welded at its periphery to the die on which it is positioned.

Fan blades of this type, for example those used as the inlet fans in a jet engine have two critical areas, one the suction or low pressure side of the inlet portion of the blade and two, the high pressure side at and near the trailing edge. Inspection procedures require measured blade angles in these two areas and the blade must conform to the inspection tolerances or limits.

A feature of the present invention is a device in which both sides of the blade are contacted by the die and held securely therein, and localized pressure is applied to shape only a portion of the blade to the desired contour. Thus for example where at the leading edge of the vane it is the convex surface, the low pressure side, that is critical, the device is set up such that the remainder of the blade is securely held in the dies and a localized pressure is applied to the concave side of the blade to force it against the opposing die and restore the blade to the shape of the die in this area. Blades and vanes always vary to some extent in thickness within allowable limits in different areas, particularly near the shroud and platform areas and a hard die bottoms on the high spots and the shape of the airfoil cannot be controlled any closer than these chordal thickness vane areas. A feature of the invention is a pressure area in the dies that applies pressure to shape the blade in these areas against the die regardless of these thicker vane areas.

According to the invention, the device has opposed dies, one for each side of the blade or vane, and in one die in a selected area of the blade, a diaphragm is incorporated to apply pressure against the blade in that area only and force it against the other die to shape the blade to the desired contour in the area. Where inspection procedures require particular angles or dimensions on one side of the blade at the leading and on the opposite side near the trailing edge, each of the dies may incorporate a localized pressure diaphragm so positioned as to shape the leading edge along the convex or suction side by pressing it against the opposing die, and another diaphragm so located near the trailing edge as to press the concave side of the trailing edge against the opposing die.

More broadly, the invention includes the concept of a flexible diaphragm positioned over an area of one of a pair of dies and so positioned as to apply pressure over a selected area of the article between the dies and to force the selected part of the article against the other die, with the diaphragm securely welded to the die around the periphery of a recess in the die coextensive with the diaphragm so as to prevent any leakage of fluid from beneath the diaphragm. It is understood that in an operation of this type the blade must be raised to a high temperature in order to reform it so that the diaphragm must be of a material to withstand the heat required. Accordingly, conventional sealing means are unusable in their environment.

The foregoing and other objects, features and advantages of the present invention will become more apparent in the light of the following detailed description of the preferred embodiments thereof as shown in the accompanying drawing.

BEST MODE FOR CARRYING OUT THE INVENTION

Figure 1:
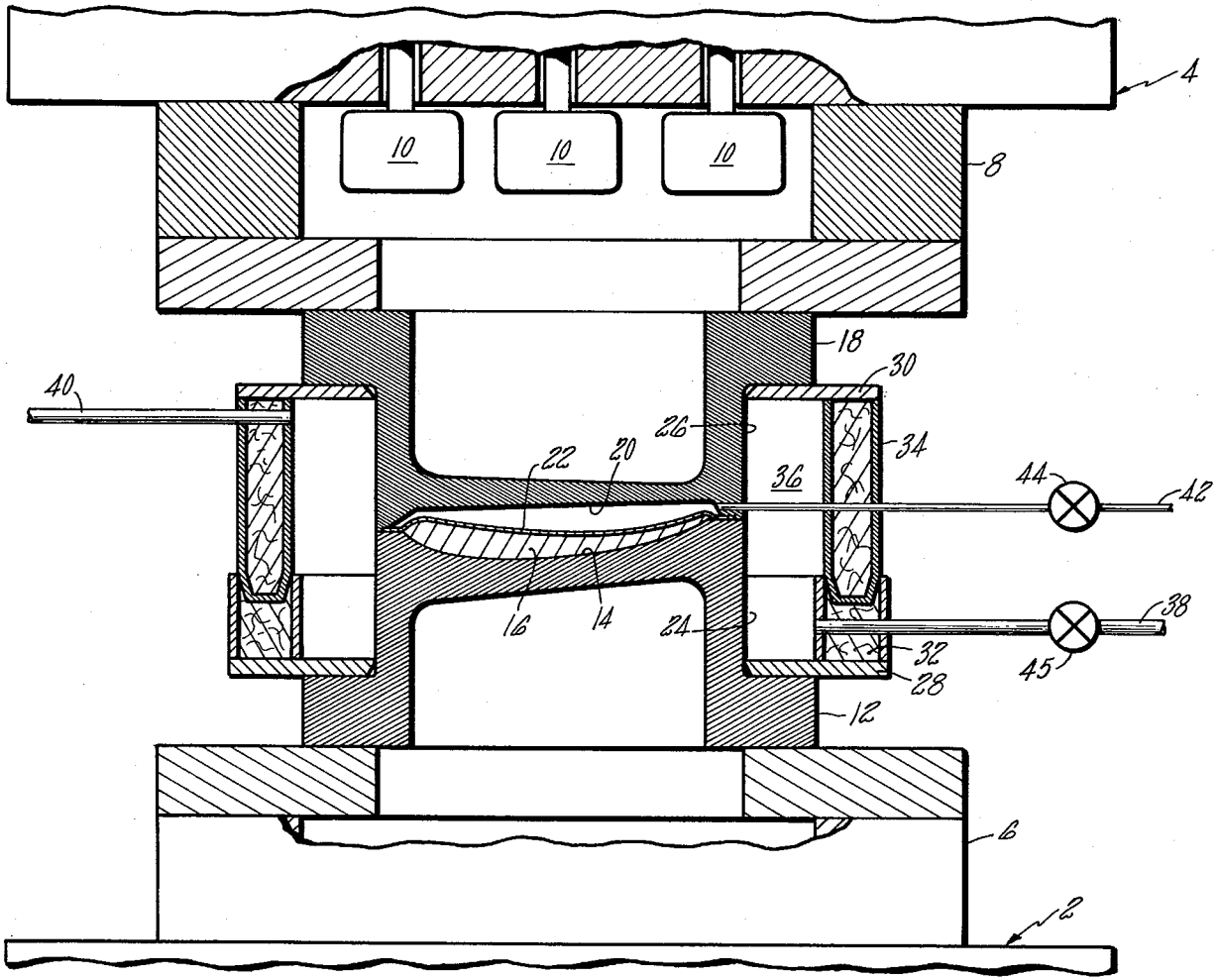
FIG. 1 is a vertical sectional view through a die assembly incorporating the invention in which the selected area of the blade is the entire side.

The invention is shown in conjunction with a press that has a bed 2 and in opposed relation thereto a head 4 that is movable toward and from the bed. On both the bed 2 and head 4 are heater bases 6 and 8 having suitable heaters 10 therein, the heaters 10 being shown only in the base 8. A fixed die 12 is mounted on the heater base 6 and on its upper surface has a recess 14 shaped to conform to one side of the article to be operated on, a fan blade 16 in this case. In opposition to the die 12 is the movable die 18 mounted on the base 8 and having a recess 20 therein opposite to the recess 14. A metallic diaphragm 22 extends over the recess 20 and is welded along all its edges to the die 18 at the periphery of the recess 20 to form a gas tight enclosure. This diaphragm 22 engages against the top side of the blade, the side opposite to that engaging the recess 14.

The dies 12 and 18 have cooperating peripheral grooves 24 and 26 and plates 28 and 30 are secured to the bottom of groove 24 and top of groove 26 respectively. Plate 28 has an upwardly opening trough 32 thereon and plate 30 has a depending flange 34 to fit into the trough. The flange and trough are so arranged that, when in interengagement they define a chamber 36 surrounding the opposed dies that may be filled with an inert gas during operation of the device. A gas supply line 38 is shown extending through the trough 32 and a gas vent line 40 extends out through the flange 34. This flange 34 is hollow and being closed at both top and bottom may be filled with suitable insulation to minimize the loss of heat from the dies. The trough may also be filled with an insulation to be compacted as the flange enters the trough.

In operation, a blade to be shaped or reshaped against the recess in die 12 is placed in position therein and the dies are then brought together into the position shown. An inert gas, for example argon, is then supplied to chamber 36 and the dies, already being hot from the heaters bring the blade up to a formable temperature. An inert gas under high pressure is then supplied to the recess 20 as through a supply line 42 to force the blade against the contours of the recess 14 in die 12 thereby bending the blade to the desired shape. The high pressure gas in the recess 29 is retained therein by the secure attachment of the diaphragm to the periphery of the areas. After the necessary time for heating and shaping the blade has elapsed the pressure in recess 20 is relieved as by a valve 44 in the supply line 42, the pressure in chamber 36 is relieved, as by a valve 45 in line 38, the dies are moved apart and the blade may be removed from the recess 14.

Figure 2:
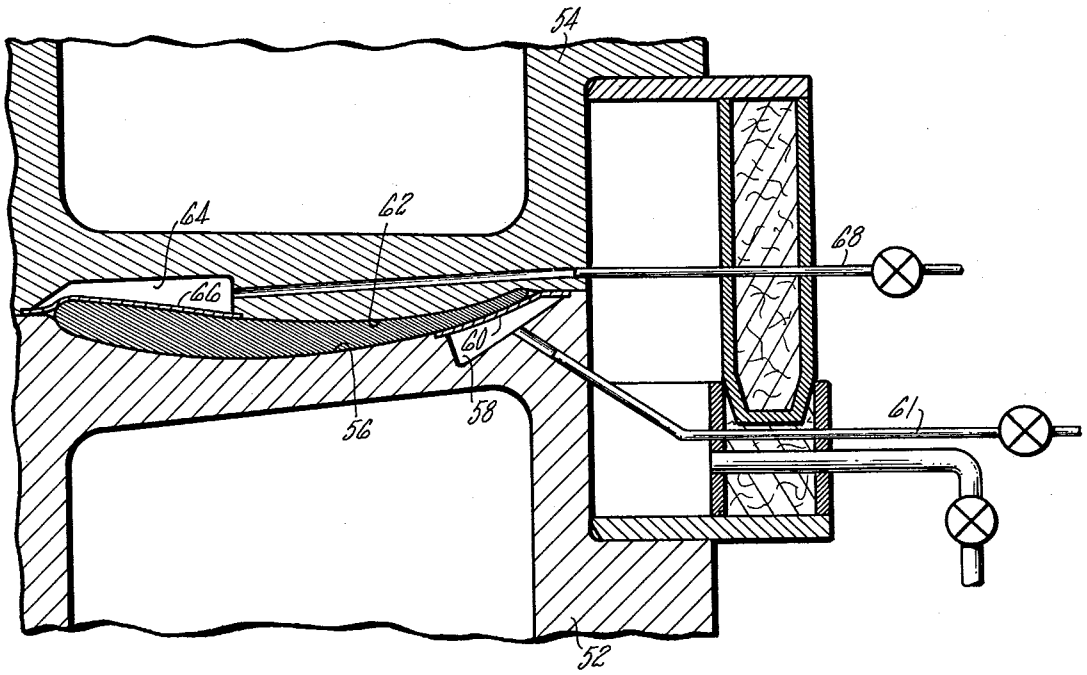
FIG. 2 is a sectional view of a modification in which two diaphragms and pressure recesses are utilized for spaced small selected areas on opposite sides of the blade

The device as above described is adequate where the blade may be shaped against a single surface, the wall of the recess 14, to establish the desired blade shape. However, where the inspection surfaces are on opposite sides of the blade or vane, as for example when the convex surface near the leading edge is critical and the concave surface near the trailing edge is critical it may be desired to apply the shaping pressures to opposite sides of the blades in selected areas only. Thus in FIG. 2, which shows only the two dies 52 and 54 corresponding to the dies 12 and 18 respectively of FIG. 1, the die 52 has a recess 56 corresponding in general to the shape of the convex side of the blade but with a deeper recess 58 near the trailing edge of the blade. The recess 58 has a diaphragm 60 welded to the die 52 around the periphery of the recess 58 and inert gas under a high pressure is admitted to the recess through a conduit 61.

Similarly die 54 has a recess 62 therein corresponding in general to the shape of the concave side of the blade and having a deeper recess 64 therein near the leading edge of the blade and the recess 64 has a diaphragm 66 overlying it and welded to the die 54 at the periphery of recess 64. Inert gas under high pressure is admitted to this recess 64 through a conduit 68 for applying a high pressure to the blade in this selected area and to force it against the recess 56 which corresponds in this area to the desired blade shape. With this arrangement, when a blade has been reformed in this device, the convex surface of the blade near the leading edge and the concave surface of the blade near the trailing edge will both have been securely pressed and shaped against the precision die surfaces in these areas. These blade surfaces will, when so shaped, bear the desired relation to each other and to the remainder of the blade so that the entire blade will pass dimensional inspection and be usable again in the engine. It will be understood that the blades so reformed are metallic, for example titanium and the diaphragms are necessarily flexible metallic diaphragms capable of withstanding the high temperatures required and also capable of being welded to the dies to assure gas tight enclosures at the temperatures involved.

Although the invention has been shown and decribed with respect to a preferred embodiment thereof, it should be understood by those skilled in the art that other various changes and omissions in the form and detail thereof may be made therein without departing from the spirit and the scope of the invention.

I claim:

1. In a die assembly for reforming an article having an irregular shape such as a fan blade, a die having a shaped surface conforming to one surface of the article, an opposed die having a cooperating shaped surface, said dies cooperating to form a cavity to receive the article, a flexible metallic diaphragm overlying only a part of one of said surfaces of one of said dies and in a position to engage a portion only of said article, said diaphragm being welded along its edges to the associated die to form a fluid tight chamber between said one surface and said diaphragm, and means for supplying a fluid under pressure to said chamber in back of said diaphragm to urge said diaphragm against the adjacent portion of the article.

2. The assembly as in claim 1 including, means for heating each of said dies for heating the article positioned therein.

3. The assembly as in claim 1 including, means for moving said dies together to hold an article therebetween; and means surrounding said dies to form a gas chamber around said dies when they are together.

4. The assembly as in claim 3 in which said surrounding means includes a trough surrounding one of said dies and a flange on the other die to engage the trough.

5. The assembly as in claim 4 in which the flange is hollow and insulated.

6. The assembly as in claim 3 including means for supplying the same gas to the chamber as to the diaphragm.

7. In a die assembly for reforming an irregularly shaped article such as a fan blade in which the critical surfaces near the trailing and leading edges are on opposite sides of the blade;

a die having a shaped surface conforming to one surface of the article;

an opposed die having a cooperating shaped surface, said dies cooperating to form a cavity to receive the article;

a flexible metallic diaphragm on one die adjacent one end of the cavity in a position to engage the article adjacent one edge thereof, said diaphragm being welded along its edges to the associated die to form a fluid tight connection therewith and to form a chamber;

another flexible metallic diaphragm on the other die adjacent the opposite end of the cavity in a position to engage the article adjacent the opposite edge thereof, said diaphragm being welded along its edges to said other die to form a fluid tight connection therewith and to form a chamber;

means for supplying fluid under pressure in back of each diaphragm to press it against the adjacent area of the article whereby one side of the article is pressed against one part of one of said dies along one edge of the article and the other side of the article is pressed against the other die along the other edge.

8. A die assembly as in claim 7 including means for heating both of said dies to heat the article therein.

9. A die assembly as in claim 7 including means surrounding said dies to form a gas chamber when the dies are closed and means for supplying an inert gas to said chamber.

10. A die assembly as in claim 9 in which said surrounding means include a trough surrounding one of said dies and a flange on the other die to engage the trough.

* * * * *